US007950331B2

(12) United States Patent
Tourdot et al.

(10) Patent No.: US 7,950,331 B2
(45) Date of Patent: May 31, 2011

(54) NARROW SLOT ROLLER AND GUIDE SYSTEM FOR HIGH DENSITY MOBILE STORAGE SYSTEMS

(75) Inventors: Matthew A. Tourdot, Whitewater, WI (US); Steven L. Janson, Deerfield, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 325 days.

(21) Appl. No.: 11/937,774

(22) Filed: Nov. 9, 2007

(65) Prior Publication Data

US 2009/0120321 A1 May 14, 2009

(51) Int. Cl.
*A47B 53/00* (2006.01)

(52) U.S. Cl. ..... 104/108; 312/198; 312/201; 104/106; 104/139

(58) Field of Classification Search ..... 104/106–109, 104/139, 140, 165, 168, 171; 312/200, 201; 16/87.4 R, 91, 95 R, 97, 100, 106
See application file for complete search history.

(56) References Cited

U.S. PATENT DOCUMENTS

| | | | | |
|---|---|---|---|---|
| 4,802,622 | A | 2/1989 | Homan | |
| 4,807,765 | A | 2/1989 | Brown et al. | |
| 4,911,507 | A | 3/1990 | Leist | |
| 4,944,231 | A | 7/1990 | Leist | |
| 5,007,351 | A | 4/1991 | Muth | |
| 5,013,101 | A | 5/1991 | Muth | |
| 5,205,627 | A | 4/1993 | Davison et al. | |
| 5,421,267 | A * | 6/1995 | Mesko et al. | 104/168 |
| 5,597,217 | A * | 1/1997 | Hoska et al. | 312/201 |
| 5,624,166 | A | 4/1997 | Theken et al. | |
| 6,007,248 | A * | 12/1999 | Fulterer | 384/53 |
| 6,112,917 | A | 9/2000 | Baker et al. | |
| 6,298,975 | B1 * | 10/2001 | Fortenbery et al. | 198/370.03 |
| 6,526,702 | B2 * | 3/2003 | Jones | 52/64 |
| 6,669,314 | B1 | 12/2003 | Nemec et al. | |
| 6,688,708 | B1 | 2/2004 | Janson | |
| 6,843,180 | B1 * | 1/2005 | Keaton | 104/248 |
| 6,948,785 | B1 | 9/2005 | Frank | |
| 7,114,789 | B2 | 10/2006 | Keaton | |
| 7,165,497 | B2 | 1/2007 | Gilbert et al. | |
| 2004/0065224 | A1 | 4/2004 | Gilbert et al. | |
| 2004/0104647 | A1 | 6/2004 | Nemec et al. | |
| 2004/0150299 | A1 * | 8/2004 | Keaton | 312/201 |
| 2006/0124025 | A1 | 6/2006 | Janson et al. | |
| 2006/0232174 | A1 | 10/2006 | Muth et al. | |

* cited by examiner

*Primary Examiner* — S. Joseph Morano
*Assistant Examiner* — Zachary Kuhfuss
(74) *Attorney, Agent, or Firm* — Andrus, Sceales, Starke & Sawall, LLP

(57) ABSTRACT

A narrow slot roller and guide system for high density mobile storage systems having a plurality of storage units. The roller and guide system includes a longitudinally extending axial guide defining a first slot in a floor and a drive rail parallel thereto defining a second slot in the floor. The axial guide includes a roller arrangement adapted to engage a downwardly extending guide member coupled to the carriage of the storage units. The engagement of the roller arrangement and guide member serves as a guide for the storage units as the storage units are moved axially along the axial guide and drive rail. Further, the present invention limits the width of the first and second slots to a very narrow width, e.g. less than one half inch, thereby easily permitting disabled individuals to freely travel across a floor in which the roller and guide system is mounted. The roller and guide system may include an anti-tip assembly to prevent the tipping of the storage units as the storage units are moved along the axial guide and drive rail.

18 Claims, 5 Drawing Sheets

NARROW SLOT ROLLER AND GUIDE SYSTEM FOR HIGH DENSITY MOBILE STORAGE SYSTEMS

BACKGROUND AND SUMMARY OF THE INVENTION

This invention relates to a rail-mounted mobile system such as a mobile storage system, and more particularly to an ADA-compliant roller guided arrangement for such a system.

A rail-mounted mobile system, such as a mobile storage system, includes one or more movable members supported on a series of spaced apart parallel rails. In a mobile storage application, the movable members are typically in the form of carriages having wheels that are supported on the spaced apart rails. A series of storage units, such as shelves or cabinets, are mounted to each carriage.

Various guide rail arrangements are known for the movement of carriage-mounted storage units. One such example of such an arrangement is shown and described in U.S. Pat. No. 7,165,497 to Gilbert et al. The '497 patent discloses a longitudinally extending track support system and track members for a mobile storage unit. The upper support surface of the track support system has at least one protrusion which projects above and extends longitudinally along the upper surface. A mating recess extends within and along the undersurface of the track member. The recess and protrusion are sized and shaped to provide loose-fit longitudinal engagement of the protrusion within the recess when the track member is laid atop the track support. This permits limited transverse movement of the track member with respect to the track support, reducing susceptibility of the wheels to derailment if a transverse force is applied to the mobile storage unit as it rolls along the track.

Another example of a guide rail arrangement is shown in U.S. Pat. No. 6,948,785 to Frank, which discloses a track system for high-density mobile storage carriages. The system includes parallel tracks for receiving a rail on which the mobile carriages are moved. The tracks are supported on a building floor by multiple transverse leveler channels. The tracks are used to support the wheels of the mobile carriages for efficient rolling along the building floor.

However, the arrangements of the prior art, such as is shown and disclosed in the '497 and '785 patents, suffer from certain disadvantages. Specifically, prior art arrangements require the utilization of guide rails that receive rollers for providing movement of the carriage relative to a support surface such as a floor. Such systems require that openings in the floor for accommodating the rails of the mobile carriage systems are wide enough to receive the rollers on the carriage that are supported on the rails. Under the Americans with Disabilities Act, however, openings in floor surfaces must comply with certain standards, e.g. such openings must be no wider than ½ inch. The aforementioned systems, however, do not meet these guidelines as the floor openings must be large enough to accommodate the rollers, which prevents the use of such rail and roller support systems in many applications.

Accordingly, it is an object of the present invention to provide a guide rail arrangement for a mobile storage system that requires relatively narrow openings in the floor surface, to enable compliance with standards such as the Americans with Disabilities Act. It is a further object of the present invention to provide a narrow opening anti-tip arrangement in which the anti-tip member is carried by a moveable member (i.e., the carriage) to prevent the carriage from tipping during the movement along a drive rail of the system.

In accordance with one aspect of the present invention, a guidance arrangement for a mobile storage system, which includes a series of storage units, has an axial guide mounted within a floor, which defines an upwardly open slot accessible from above a top surface of the floor. The guidance arrangement also includes a drive rail mounted within the floor and extending parallel to the axial guide. A top surface of the drive rail is flush with a top surface of the floor. A roller arrangement is associated with the axial guide, and is located within the upwardly open slot. A rotatable drive wheel is carried by one of the storage units, and is engaged with the top surface of the drive rail. A guide member extends downwardly from the storage unit and into the upwardly open slot, and engages the roller arrangement so as to guide movement of the storage unit as the storage unit is moved along the axial guide by movement of the drive wheel on the drive rail.

In accordance with another aspect, the present invention contemplates a rail system for high density mobile storage assemblies having a number of storage units. The rail system includes an axial guide mounted beneath a floor and defining a first upwardly open slot. A drive rail is mounted beneath the floor parallel to the axial guide, and defines a second upwardly open slot, and is configured to allow for wheels of the storage units to ride thereon. A roller arrangement is mounted within the first upwardly open slot, and is adapted to receive a guide member extending downwardly from the storage units to guide movement of the storage unit at a location spaced from the wheels and the drive rail.

The invention also contemplates a method of guiding movement of a mobile storage unit relative to a floor. The method includes the steps of moving the storage unit by rotation of a drive wheel on a drive rail at a first location, and guiding movement of the storage unit at a second location spaced from the first location, by engaging a downwardly extending guide member associated with the storage unit with a guide arrangement that includes an upwardly open slot through which the guide member extends. The guide arrangement includes spaced apart engagement members that engage the guide member below the floor as the guide member is moved along the upwardly open slot.

Various other features, objects and advantages of the invention will be made apparent from the following description taken together with the drawings.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
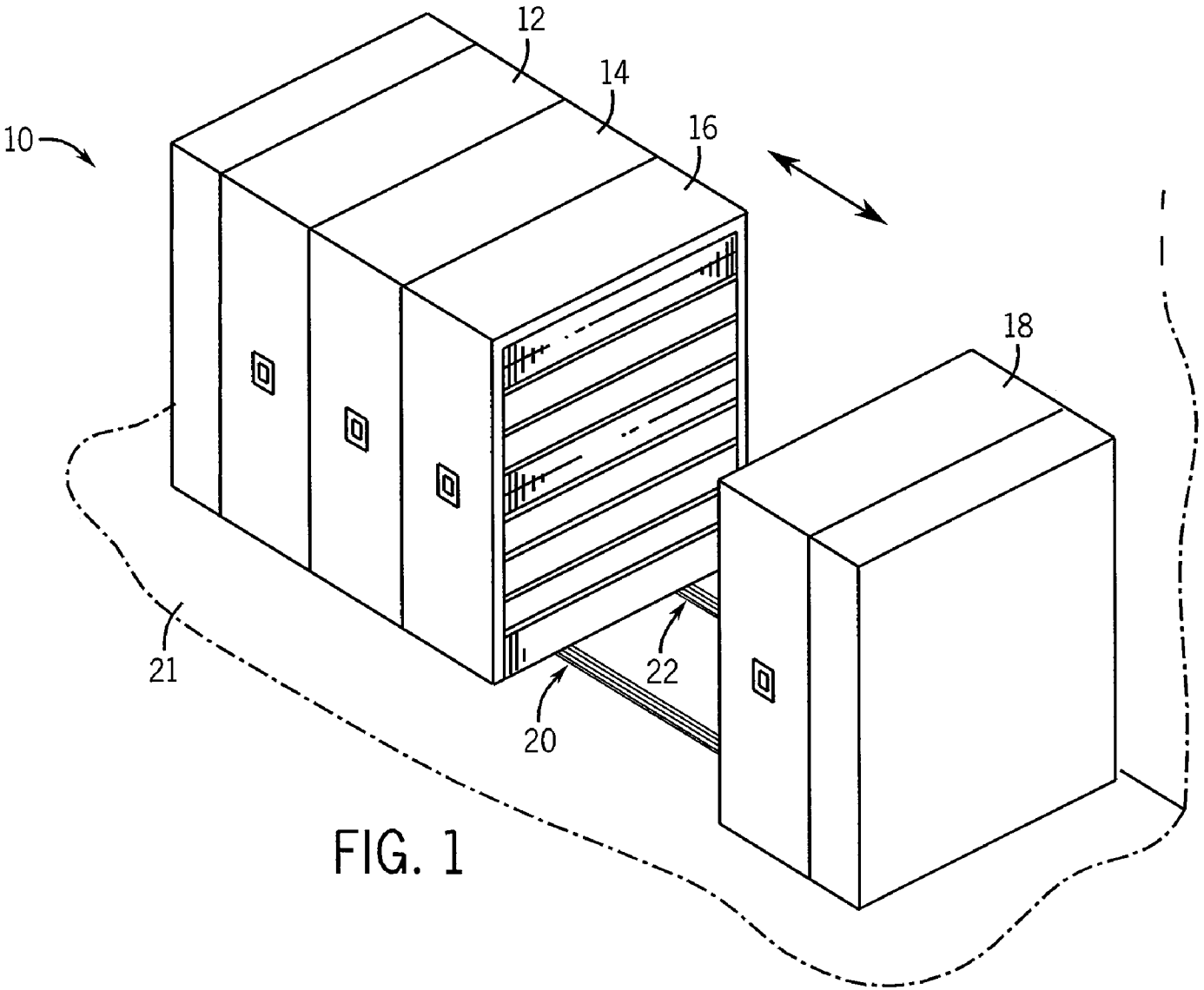
FIG. 1 is an isometric view showing a mobile system, in the form of a mobile storage system, which incorporates the roller and guide system of the present invention.

Referring initially to FIG. 1, a mobile system in the form of a mobile storage system 10 includes a series of storage units 12, 14, 16 and 18. Storage units 12, 14, 16 and 18 are movably supported on a supporting surface 21, such as a floor, via a floor-mounted guidance system in accordance with the present invention, which includes an axial guide 20 and a drive rail 22. Storage units 12, 14, 16 and 18 are movable on axial guide 20 and drive rail 22 together and apart to selectively create an aisle or space providing access to the contents of storage units 12, 14, 16 and 18. The illustrated embodiment shows a single guide 20 and drive rail 22, on which storage units 12-18 are movable. It is understood, however, that storage units 12-18 may have a longer length than that illustrated, and that several sets of guides 20 and drive rails 22 may be employed.

Representatively, the general construction and operation of mobile storage system 10 is similar to that of mobile storage systems such as are available from Spacesaver Corporation of Fort Atkinson, Wis.

Figure 2:
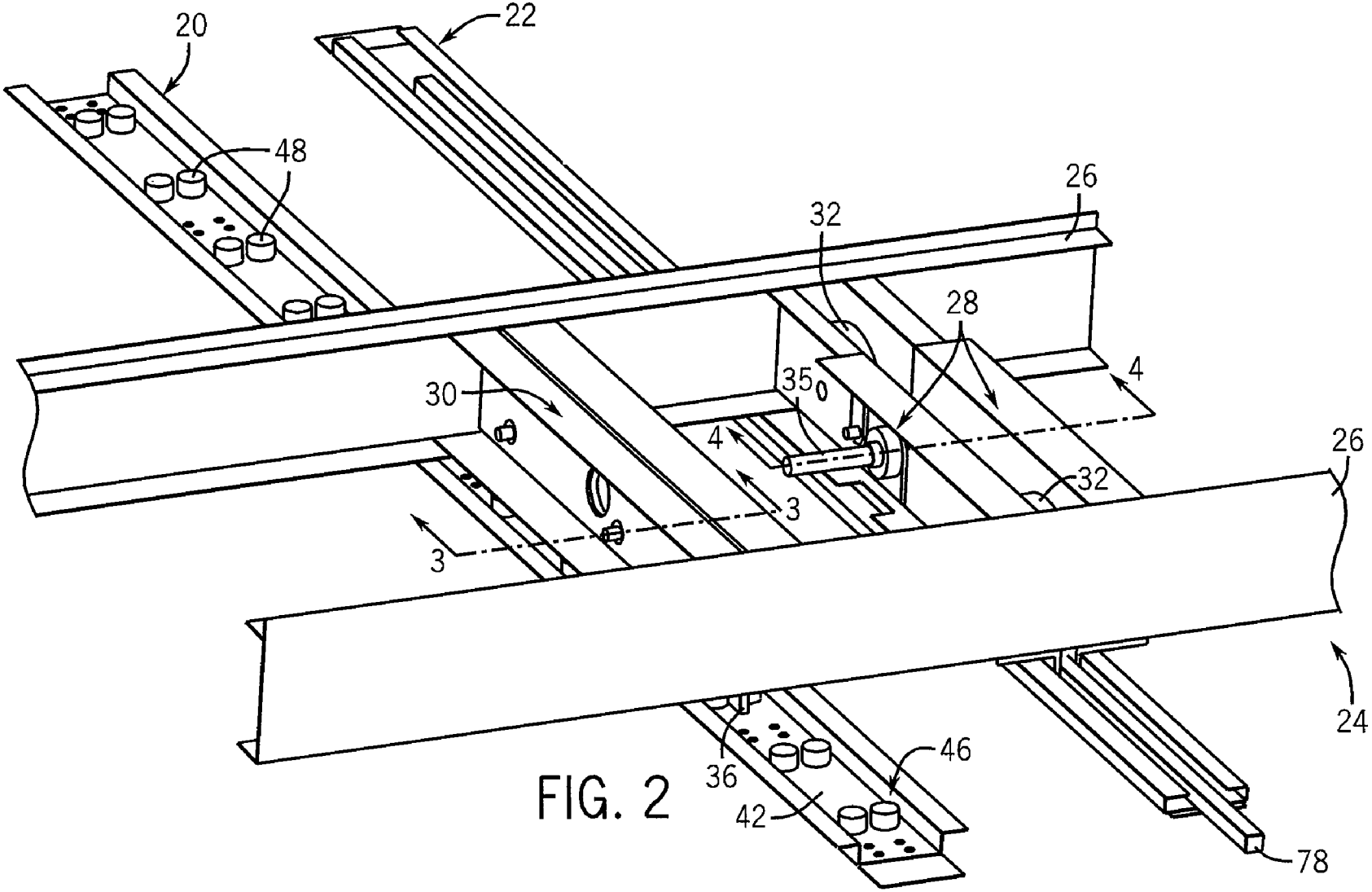
FIG. 2 is a partial isometric view of the roller and guide system of the present invention incorporated into the mobile storage system of FIG. 1.
Figure 4:
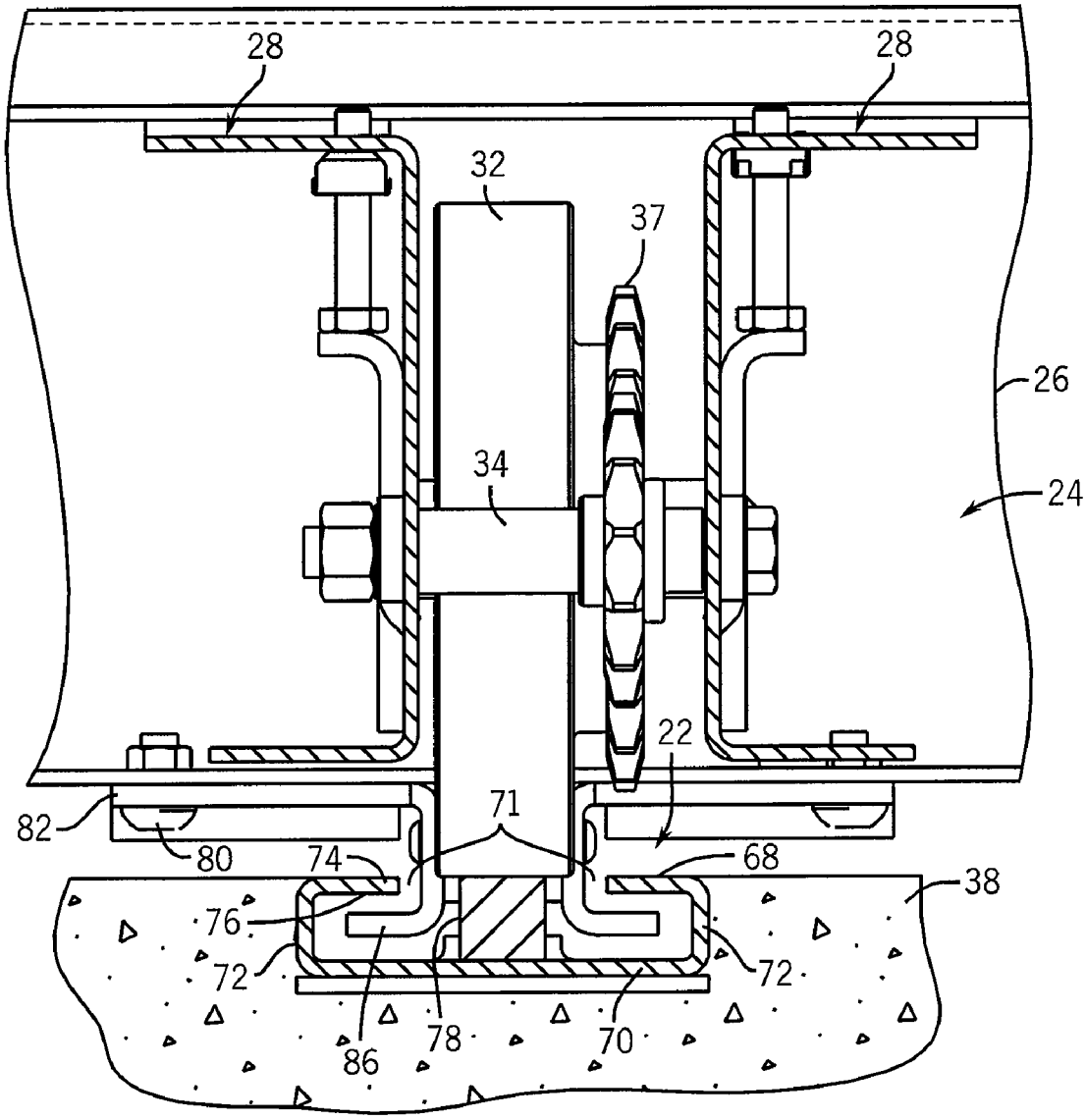
FIG. 4 is a partial cross-sectional view along line 4-4 of FIG. 21.

Turning now to FIG. 2, each of the mobile storage units 12, 14, 16 and 18 includes a carriage, a portion of which is shown at 24. In accordance with known construction, each carriage 24 includes a pair of frame members 26 which span transversely across the parallel axial guide 20 and drive rail 22 for movably supporting one of the storage units 12, 14, 16 and 18. Carriage 24 further includes longitudinal support members 28 and 30. Support member 28 is generally aligned along a longitudinal axis defined by drive rail 22 and has a plurality of wheels 32 mounted thereto, as shown in FIG. 4. Each wheel 32 is mounted to an axle 34 for rotatably supporting the wheels 32 relative to me support members 28. In a manner as is known, wheels 32 are driven into rotation by operation of a drive shaft 35, to which rotation is imparted by operation of a motor or any other satisfactory drive mechanism. Representatively, drive shaft 35 may be engaged with a drive sprocket (not shown), which imparts movement to a flexible drive members such as a chain, which in turn is engaged with a driven sprocket 37 (FIG. 4) that drives one or both of wheels 32 into rotation in response to rotation of drive shaft 35.

Figure 3:
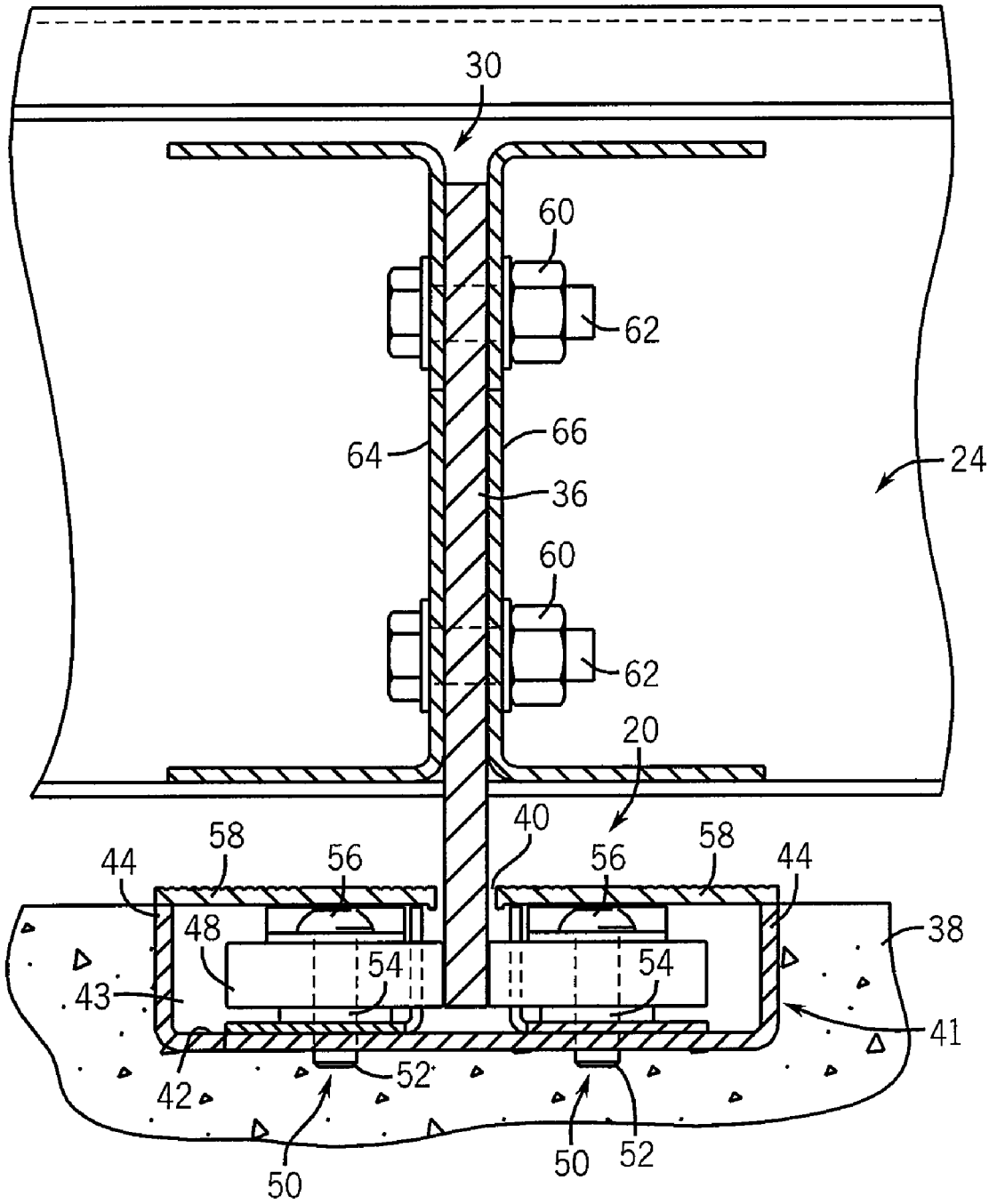
FIG. 3 is a partial cross-sectional view along line 3-3 of FIG. 2.

Support member 30 is generally aligned with a longitudinal axis defined by axial guide 20. As shown in FIG. 3, support member 30 includes a downwardly extending guide member 36 for guiding the carriage 24. The guide member 36 preferably has a generally rectangular cross section, although it is understood that any other satisfactory shape or configuration may be employed.

As can be seen in FIGS. 2 and 3, axial guide 20 is generally mounted within a floor 38 and defines an upwardly open slot 40 accessible from above a top surface of floor 38. Slot 40 is defined by a channel member 41 which is embedded within floor 38, in combination with a pair of cover plates 58. In the illustrated embodiment, channel member 41 includes a bottom wall 42 and a pair of side walls 44, which defines an internal cavity 43. Side walls 44 preferably terminate slightly below the upper surface of floor 38. Cover plates 58 are secured to the upper edges of side walls 44, and are flush with floor 38. The inner edges of cover plates 58 form slot 40, and are configured so as to provide slot 40 with a very narrow width. Representatively, cover plates 58 are configured so that slot 40 has a width that is less than ½ inch, in order to accommodate individuals with disabilities who may need to travel over the floor 38.

Axial guide 20 further includes a roller arrangement 46 along a top surface of bottom wall 42. Roller arrangement 46 is in the form of a number of pairs of roller members 48. Roller members 48 are coupled to bottom wall 42 by means of a threaded screw 50 or the like. Screw 50 preferably includes a lower end portion 52, a shaft 54, and an upper head portion 56. Lower end portion 52 is received by a hole or aperture in the bottom wall 42 of axial guide 20 and extends into the floor 38 to secure the roller members 48 in place. Shaft 54 extends through a centrally located hole or passage in roller member 48, such that each roller member 48 is freely rotatable around the shaft 54 of one of screws 50. A bottom surface of head portion 56 engages a top surface of roller member 48.

While the preferred embodiment of the present invention utilizes roller member pairs to guide the storage units along axial guide 20, it is understood that other guidance arrangements are contemplated. For example, and without limitation, it is contemplated that spaced apart guides having low friction surfaces, such as nylon surfaces, may be positioned within cavity 43 below cover plates 48. Accordingly, any other such guidance system that is capable providing a narrow slot within the floor surface may be utilized in accordance with the present invention.

Roller members 48 are configured to receive guide member 36 therebetween. The pairs of roller members 48 are spaced to ensure that guide member 36 is in contact with at least one pair of roller members 48 at one time. Preferably, however, the roller member pairs 48 are spaced such that more than one pair of roller members 48 are in contact with the guide member 36 at one time. Nevertheless, the pairs of roller members 48 should not be spaced more than 6 inches apart from one another.

Guide member 36 is configured to extend into and through slot 40, and to be positioned between roller members 48 so as to guide movement of the associated one of storage units 12, 14, 16, and 18 as the storage unit is moved along the axial guide 20 by movement of the wheels 32 on drive rail 22. Preferably, the engagement between guide member 36 and roller members 48 is substantially frictionless, thereby allowing for relatively smooth movement of storage units 12, 14, 16, 18 along the length of axial guide 20.

As shown in FIG. 3, guide member 36 is coupled to carriage 24 by way of two nuts 60 and bolts 62 extending through a pair of holes formed in a pair of webs 64, 66 defined by mirror image channel members which make up carriage support 30 Guide member 36 is positioned between the webs 64, 66, and is secured thereto using nuts 60 and bolts 62. The bolts 62 are inserted through openings formed in web 64, through aligned openings formed in guide member 36, and through openings formed in web 66. The nuts 60 are then secured to be threaded end portions of bolts 62 to clamp guide member 36 between webs 64 and 66.

Referring to FIGS. 2 and 4, drive rail 22 of the present invention is shown mounted within floor 38 and extending parallel to the axial guide 20. A top surface 68 of drive rail 22 is flush with the top surface of floor 38

Each drive rail 22 includes a channel defining a bottom wall 70 and a pair of spaced apart side walls 72. Each side wall 72 extends upwardly from one of the ends of bottom wall 70, and terminates in an inwardly extending lip 74 at its upper end. The underside of each lip 74 defines a downwardly facing and laterally extending engagement surface 76. In the illustrated embodiment, each engagement surface 76 is spaced above and parallel to the upwardly facing surface of bottom wall 70.

Drive rail 22 further includes a centrally mounted rail member 78, which is configured to receive wheel 32. Rail member 78 runs along the entire length of drive rail 22, and thus allows movement of storage units 12, 14, 16, and 18 thereon. Further, a top surface of rail member 78 is configured to be flush with a top surface of the floor 38, as well as with the upwardly facing surfaces of inwardly extending lips 76. The inner edge of each inwardly extending lip 76 is spaced from the facing side surface of rail member 78, so as to define a relatively narrow gap or space 71 therebetween. Representatively, the inwardly extending lips 76 and the rail member 78 are configured so that slot gap or space 71 formed a slot having a width that is less than ½ inch, in order to accommodate individuals with disabilities who may need to travel over the floor 38.

The system 10 of the present invention may additionally include an anti-tip assembly which is configured to prevent the tipping of storage units 12, 14, 16 and 18 as the storage units are moved along drive rail 22. The anti-tip assembly of the present invention is preferably carried by carriage 24 so as to be movable therewith.

In the illustrated embodiment of FIG. 4, the anti-tip assembly of the present invention comprises two generally "J-shaped" hooks 80. Each hook 80 generally includes a first end 82 coupled to a bottom surface of carriage 24 by way of a fastener 84 or the like. Fastener 84 may be in the form of a screw, a nut and bolt or any other such suitable fastener. Each hook 80 further includes a second end 86 adapted to be received within one of slots 71. With this arrangement, the ends 86 of hooks 80 cooperate with the inwardly extending lips 76 so as to restrain the associated storage unit from tipping as the storage unit is moved along the drive rail 22.

Figure 5:
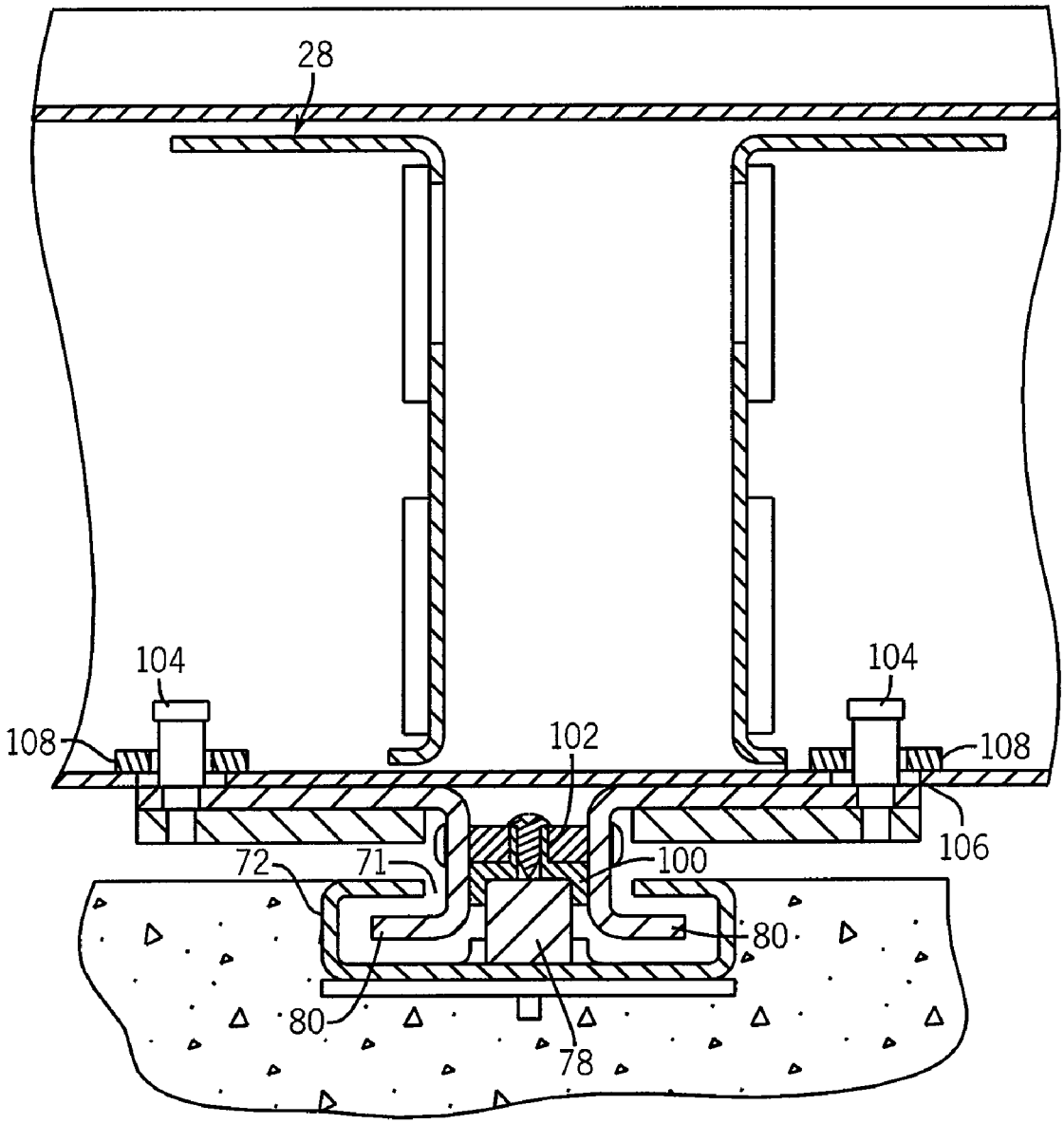
FIG. 5 is a partial-cross sectional view of the anti-tip assembly of FIG. 4 without the wheel and sprocket.

Referring now to FIG. 5, the anti-tip assembly of the present invention further comprises a low-friction guide 100 that runs along the length of rail member 78. The low-friction guide 100 may be composed of plastic, polyurethane or any other such low-friction material. The low-friction guide 100 is secured to a block 102 which is coupled to hooks 80. Block 102 is preferably comprised of a metal such as steel, though any other such suitable material may be used. The low-friction guide 100 and block 102 are configured to remain in contact with and slide along the surface of rail member 78.

The anti-tip assembly further includes a pair of shoulder screws 104 fastened to hooks 80. The shoulder screws 104 pass through slots 106 in carriage 24, thereby allowing the hooks 80 to float from side to side relative to the carriage 24. This enables the anti-tip assembly to allow for misalignment between the rails and other such mounting issues. A relatively loose washer 108 is positioned between the top of shoulder screws 104 and the inside wall of the carriage 24. The anti-tip assembly is configured such that if the carriage 24 begins to tip, the carriage 24 will lift slightly before engaging washer 108 against the head of shoulder screw 104. As such, the entire anti-tip assembly is lifted until the hooks 80 catch the inwardly extending lips 68 and 74, thus preventing tipping of the carriage 24. The anti-tip assembly of the present invention is configured to provide an effective anti-tip feature while maintaining the width of slot 71 at a very narrow width, as described above.

While the drawings and description disclosed an anti-tip system that is preferred and effective, it is to be understood that any other satisfactory anti-tip system may be employed in the practice of the present invention, as long as the anti-tip system is capable of using a slot 71 that can be maintained at a very narrow width, e.g. one half inch. Accordingly, a variety of anti-tip systems may be used, including anti-tip assemblies that are not integral with the drive rail 22 of the system 10 of the present invention.

Various alternatives and embodiments are contemplated as being within the scope of the following claims particularly pointing out and distinctly claiming the subject matter regarded as the invention.

We claim:

1. A guidance arrangement for a mobile storage system including a plurality of storage units, comprising:

an axial guide mounted within a floor, wherein the axial guide includes an open cavity accessible from above a top surface of the floor;

a pair of cover plates secured over a portion of the open cavity thereby defining a relatively narrow slot;

a drive rail mounted within the floor and extending parallel to the axial guide, wherein a top surface of the drive rail is flush with a top surface of the floor;

a roller arrangement associated with the axial guide and located within the open cavity, the roller arrangement including a plurality of roller member pairs;

a rotatable drive wheel carried by one of the storage units, wherein the drive wheel is engaged with the top surface of the drive rail;

a guide member extending downwardly from the storage unit and through the slot into the open cavity, wherein the plurality of roller member pairs are spaced to ensure that the guide member is in contact with more than one roller member at a time so as to guide movement of the storage unit as the storage unit is moved along the axial guide by movement of the drive wheel on the drive rail.

2. The guidance arrangement of claim 1 wherein the plurality of roller member pairs are spaced no greater than six inches from one another.

3. The guidance arrangement of claim 1 wherein the open slot is no greater than ½ inch in width.

4. The guidance arrangement of claim 1 wherein the guide member comprises a generally rectangular cross section.

5. The carriage guidance system of claim 1 further comprising an anti-tip assembly adapted to prevent the tipping of the storage units.

6. A guidance arrangement for a mobile storage system including a plurality of storage units, comprising:

an axial guide mounted within a floor, wherein the axial guide defines an open cavity accessible from above a top surface of the floor through a slot having a width substantially less than the width of the open cavity;

a drive rail mounted within the floor and spaced from and extending parallel to the axial guide, wherein the drive rail includes a rail member having a top surface flush with a top surface of the floor;

a roller arrangement mounted within the axial guide and located within the open cavity of the axial guide, the roller arrangement including a plurality of spaced roller pairs;

a rotatable drive wheel carried by one of the storage units, wherein the drive wheel is engaged with the top surface of the rail member;

a guide member extending downwardly from the storage unit and through the slot of the axial guide and into the open cavity, wherein the guide member engages the roller arrangement mounted within the axial guide so as to guide movement of the storage unit as the storage unit is moved along the axial guide by movement of the drive wheel on the rail member; and an anti-tip assembly adapted to prevent tipping of the storage units, wherein the anti-tip assembly includes at least one hook having a first end fixedly coupled to one of the storage units and a second end adapted to be secured within the drive rail.

7. The carriage guidance system of claim 6 wherein the drive rail further includes a lip adapted to retain the hook of the anti-tip hook assembly.

8. A guidance arrangement for a mobile storage system including a plurality of storage units, comprising:

an axial guide mounted within a floor, wherein the axial guide defines an open cavity accessible from above a top surface of the floor through a slot having a width substantially less than the width of the open cavity;

a drive rail mounted within the floor and spaced from and extending parallel to the axial guide, wherein the drive rail includes a lip and a top surface of the drive rail is flush with a top surface of the floor;

a roller arrangement associated with the axial guide and located within the open cavity;

a rotatable drive wheel carried by one of the storage units, wherein the drive wheel is engaged with the top surface of the drive rail:

a guide member extending downwardly from the storage unit and through the slot into the open cavity, wherein the guide member engages the roller arrangement so as to guide movement of the storage unit as the storage unit is moved along the axial guide by movement of the drive wheel on the drive rail;

an anti-tip assembly adapted to prevent tipping of the storage units, wherein the anti-tip assembly includes at least one hook having a first end fixedly coupled to one of the storage units and a second end adapted to be secured within the drive rail, wherein the lip of the drive rail retains the hook of the anti-tip assembly; and a low-friction guide and a block coupled to the low-friction guide, wherein the low-friction guide and block are mounted to the storage unit and configured to slide along the guide rail.

9. The carriage guidance system of claim 8 further comprising a shoulder screw and washer coupled to the carriage and at least one hook, wherein the shoulder screw and washer are configured to be engaged by the carriage upon tipping of the carriage.

10. A rail system for high density mobile storage assemblies having a plurality of storage units comprising:

an axial guide mounted beneath a floor and defining an open cavity and a first upwardly open slot;

a drive rail mounted beneath the floor spaced from and parallel to the axial guide and defining a second upwardly open slot, wherein the drive rail includes a rail member configured to allow for wheels of the storage units to ride thereon; and a roller arrangement mounted within the open cavity of the axial guide and accessible through the first upwardly open slot of the axial guide, wherein the roller arrangement includes a plurality of spaced roller pairs adapted to receive a guide member extending downwardly from the storage units to guide movement of the storage units as the storage units move along the axial guide.

11. The rail system of claim 10 wherein the first and second upwardly open slots are less than ½ inch wide.

12. The rail system of claim 10 further comprising an anti-tip assembly, wherein the anti-tip assembly is configured to prevent the storage units from tipping.

13. The rail system of claim 12, wherein the anti-tip assembly comprises at least one hook, wherein the hook has a first end coupled to the storage units and a second end received by the drive rail.

14. The rail system of claim 10, wherein the roller member pairs are spaced within the axial guide and the guide member is sized such that the guide member is in contact with at least one roller member pair at all times.

15. A rail system for high density mobile storage assemblies having a plurality of storage units comprising:

an axial guide mounted beneath a floor and defining an open cavity and a first upwardly open slot;

a drive rail mounted beneath the floor parallel to the axial guide and defining a second upwardly open slot, wherein the drive rail is configured to allow for wheels of the storage units to ride thereon; and a roller arrangement mounted within the open cavity and accessible through the first upwardly open slot of the axial guide, wherein the roller arrangement is adapted to receive a guide member having a generally rectangular cross section and extending downwardly from the storage units to guide movement of the storage units as the storage units move along the axial guide.

16. A method of guiding movement of a mobile storage unit relative to a floor, comprising the steps of:

moving the storage unit by rotation of a drive wheel on a drive rail at a first location; and guiding movement of the storage unit at a second location spaced from the first location, by engaging a generally rectangular, downwardly extending guide member associated with the storage unit with a guide arrangement that includes an open cavity accessible through an upwardly open slot through which the guide member extends, wherein the guide arrangement includes a plurality of spaced apart roller member pairs that engage the guide member below the floor as the guide member is moved along the upwardly open slot.

17. The method of claim 16 wherein the step of guiding movement of the storage unit at a second location spaced from the first location is carried out by engaging more than one pair of the roller member pairs with the guide member at one time.

18. The method of claim 16 further comprising the step of securing the storage unit by coupling an anti-tip arrangement thereto, wherein the anti-tip arrangement is configured to prevent the storage unit from tipping.

* * * * *